US005119423A

United States Patent [19]

Shiraki et al.

[11] Patent Number: 5,119,423

[45] Date of Patent: Jun. 2, 1992

[54] SIGNAL PROCESSOR FOR ANALYZING DISTORTION OF SPEECH SIGNALS

[75] Inventors: Koichi Shiraki; Kunio Nakajima, both of Kanagawa, Japan

[73] Assignee: Mitsubishi Denki Kabushiki Kaisha, Japan

[21] Appl. No.: 488,870

[22] Filed: Mar. 5, 1990

[30] Foreign Application Priority Data

Mar. 24, 1989 [JP] Japan ..... 1-70399

[51] Int. Cl.[5] ..... G10L 9/14

[52] U.S. Cl. ..... 381/31; 381/36

[58] Field of Search ..... 381/29-41; 364/513.5; 375/122

[56] References Cited

U.S. PATENT DOCUMENTS

| | | | |
|---|---|---|---|
| 4,817,157 | 3/1989 | Gerson | 381/40 |
| 4,827,517 | 5/1989 | Atal et al. | 381/41 |
| 4,868,867 | 9/1989 | Davidson et al. | 381/35 |
| 4,910,781 | 3/1990 | Ketchum et al. | 381/36 |

OTHER PUBLICATIONS

"Code-Excited Linear Prediction (CELP): High-Quality Speech At Very Low Bit Rates", Schroeder et al., IEEE ICASSP, 1985, pp. 937-940.

"Efficient Procedures For Finding The Optimum Innovation In Stochastic Coders", Trancoso et al., IEEE ICASSP 86, pp. 2375-2378.

*Primary Examiner*—Dale M. Shaw

*Assistant Examiner*—Michelle Doerrler

[57] ABSTRACT

A speech coder utilizing previously stored sound source vectors to generate synthetic speech, a distortion computing circuit for computing a distortion of synthetic speech from input speech and a selection circuit for selecting the sound source vector that provides minimum distortion. Sound source vectors are stored within a plurality of reduced size code books rather than a single larger code book. A vector adder adds the sound source vectors respectively output from each of the reduced code books thereby generating a single sound source vector for comparison with the input speech. The distortion circuit computes the distortion for this sound source vector by analyzing the sound source vectors respectively output from each of the reduced code books in addition to the sound source vector output from the vector adder. The computational complexity required to determine the distortion is greatly reduced from the complexity required if a single larger code book of sound source vectors is utilized.

16 Claims, 4 Drawing Sheets

SIGNAL PROCESSOR FOR ANALYZING DISTORTION OF SPEECH SIGNALS

BACKGROUND OF THE INVENTION

1. Field of the Invention

The present invention relates to a speech coder which subjects a speech signal to data compression prior to digital transmission or storage.

2. Description of the Related Art

There are speech coding systems in which a speech signal is separated into a parameter representative of a synthesis filter and a parameter representative of a sound source to thereby effect data compression. One example of such coding is code-excited linear prediction (hereinafter referred to as CELP).

One example of CELP is shown in M. R. Schroeder, B. S. Atal, "Code-Excited Linear Prediction (CELP): High-quality speech at very low bit rates", in *Proceedings IEEE International Conference on Acoustics, Speech and Signal Processing*, pp. 937–940 (1985). In this paper, a parameter representative of a synthesis filter is analytically obtained once every 10 msec, 40-point random noise time series, that is, 40-dimensional vectors (hereinafter referred to as "sound source vectors"), produced from random numbers, are employed as a parameter representative of a sound source time-corresponding to speech which is coded in blocks each consisting of 40 speech samples (5 msec in duration when the sampling frequency is 8 kHz).

I. M. Trancoso, B. S. Atal, "Efficient procedures for finding the optimum innovation in stochastic coders", Proceedings IEEE International Conference on Acoustics, Speech and Signal Processing, pp. 2375–2378 (1986) disclose a speech coder performing the speech coding of the Schroeder et al. paper (see FIG. 3).

Referring to FIG. 3, the reference numeral 3 denotes N-dimensional Discrete Fourier transform (hereinafter referred to as DFT) vectors obtained by subjecting sound source vectors, which are J-point sampling value sequences, to 2·N-point DFT. The reference numeral 1 denotes a code book comprising L DFT sound source vectors 3. The reference numeral 5 denotes a change-over switch used to select the DFT sound source vectors 3 stored in the code book 1. Denominator term computing circuit 15 outputs a denominator term 17 for distortion computation on the basis of the squared value 16 (hereinafter referred to as "squared evaluation weight") of the amplitude term of certain frequency characteristics (hereinafter referred to as "evaluation weighting filter"). Those frequency characteristics are obtained by subjecting the DFT sound source vector 3 and the impulse response of the synthesis filter to 2·N-point DFT. Vector product sum computing circuit 8 is supplied as its inputs, with the DFT sound source vector 3 and the weighted DFT input speech 7. Weighted DFT input speech 7 is the product of the evaluation weighting filter output and the conjugate complex number of what is obtained by subjecting input speech which is a J-point sampling value sequence to 2·N-point DFT. In response to those inputs, vector product sum computing circuit 8 outputs a numerator term vector product sum 10 for distortion computation. Final distortion computing circuit 12 computes a distortion 18 of the synthetic speech from the input speech in the frequency domain on the basis of the numerator term vector product sum 10 and the denominator term 17. Optimum sound source vector selecting circuit 19 selects a sound source vector code 20 corresponding to a sound source vector having the smallest distortion 18. The reference symbol A denotes a distortion computing means.

The operation will next be explained by use of the flowchart shown in FIG. 4.

When the k-th one of the L DFT sound source vectors 3 stored in the code book 1 is used, distortion 18 is generally known as follows:

$$E(k) = \sum_{i=1}^{N} |X(i) - g(k) \cdot H(i) \cdot C(i,k)|^2 \tag{1}$$

where X(i) is the i-th component in the DFT input speech, H(i) the i-th component in the evaluation weighting filter, C(i, k) the i-th component in the k-th DFT sound source vector, and g(k) the gain coefficient that minimizes the distortion E(k).

First, the vector product sum computing circuit 8 is supplied, as its inputs, with the DFT sound source vector C(i, k) and the weighted DFT input speech Y(i). These inputs enable circuit 8 to output the following numerator term vector product sum P(k) (Step ST1):

$$P(k) = Re. \sum_{i=1}^{N} \{Y(i)^* \cdot C(i,k)\} \tag{2}$$

where Y(i)* denotes the conjugate complex number of Y(i) which satisfies the relation of $Y(i)=X(i)\cdot H(i)^*$, and the symbols Re. and Im. denote the real and imaginary numbers, respectively, of the complex number.

The denominator term computing circuit 15 is supplied, as its inputs, with the DFT sound source vector C(i,k) and the squared evaluation weight $a(i)^2$, to output the following denominator term 17 (Step ST2):

$$\sum_{i=1}^{N} a(i)^2 \cdot |C(i,k)|^2 \tag{3}$$

Since $a(i)^2$ is the square of the evaluation weighting filter H(i), the relation of $a(i)^2 = |H(i)|^2$ is satisfied.

Next, the final distortion computing circuit 12 is supplied, as its inputs, with the numerator term vector product sum P(k) expressed by the equation (2) and the denominator term 17 expressed by the equation (3) to output the following distortion E(k) (Step ST3):

$$E(k) = \sum_{i=1}^{N} |X(i)|^2 - \frac{\{P(k)\}^2}{\sum_{i=1}^{N} a(i)^2 \cdot |C(i,k)|^2} \tag{4}$$

It should be understood to be known that the equation (4) is obtained by selecting a gain coefficient g(k) that minimizes the distortion E(k) of the equation (1) and that the equation (4) is equivalent to the equation (1).

After the final distortion computing circuit 12 completes the computation of distortions 18 for all the L DFT sound source vectors 3 (Step ST4), the optimum sound source vector selecting circuit 19 selects as an optimum sound source vector code 20 the number of the DFT sound source vector 3 that gives the smallest value of the L distortions 18 (Step ST5).

The conventional speech coder described above carries out L numerator term vector multiply-add operations in the vector product sum computing circuit 8 to compute L distortions. This conventional speech decoder needs to increase the value of L (e.g., L=1024) in order to code speech in high quality (i.e., the synthetic speech includes no noise). However, if L is increased, the computational complexity, that is, the number of multiply-add operations, required for the distortion computation becomes enormous and, at the same time, the memory capacity needed for the code book increases enormously, resulting in an exceedingly large-scale speech coder.

SUMMARY OF THE INVENTION

In view of the above-described problems of the prior art, it is a primary object of the present invention to reduce the number of computational operations required for the distortion computation and thereby obtain a small-scale speech coder.

To this end, the present invention provides a speech coder comprising: a plurality of reduced code books extracted from a code book; a vector adder which adds sound source vectors respectively selected from the reduced code books to produce a single sound source vector; and a distortion computing means for computing a distortion on the basis of the sound source vector produced by the vector adder and the sound source vectors respectively selected from the reduced code books.

The vector adder in the present invention adds sound source vectors respectively selected from a plurality of reduced code books to produce a single sound source vector, and the distortion computing means in the present invention computes a distortion on the basis of the sound source vector produced in the vector adder and the sound source vectors respectively selected from the reduced code books.

BRIEF DESCRIPTION OF THE DRAWINGS

The above and other objects, features and advantages of the present invention will become more apparent from the following description of the preferred embodiment thereof, taken in conjunction with the accompanying drawings, in which like reference numerals denote like elements, and of which.

DETAILED DESCRIPTION OF THE PREFERRED EMBODIMENT

One embodiment of the present invention will be described below with reference to the accompanying drawings.

Figure 1:
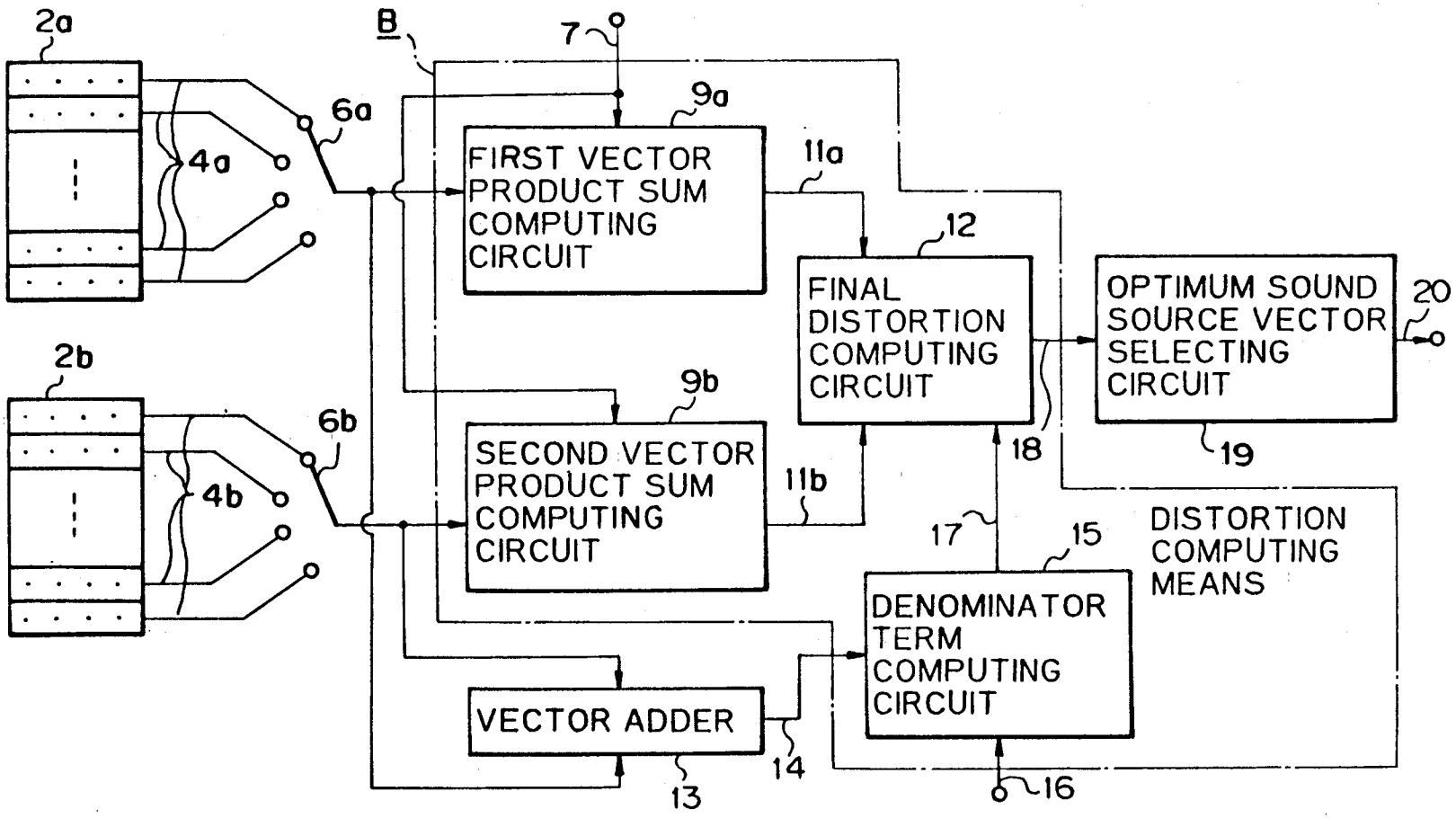
FIG. 1 is a block diagram showing the arrangement of one embodiment of the speech coder according to the present invention.
Figure 3:
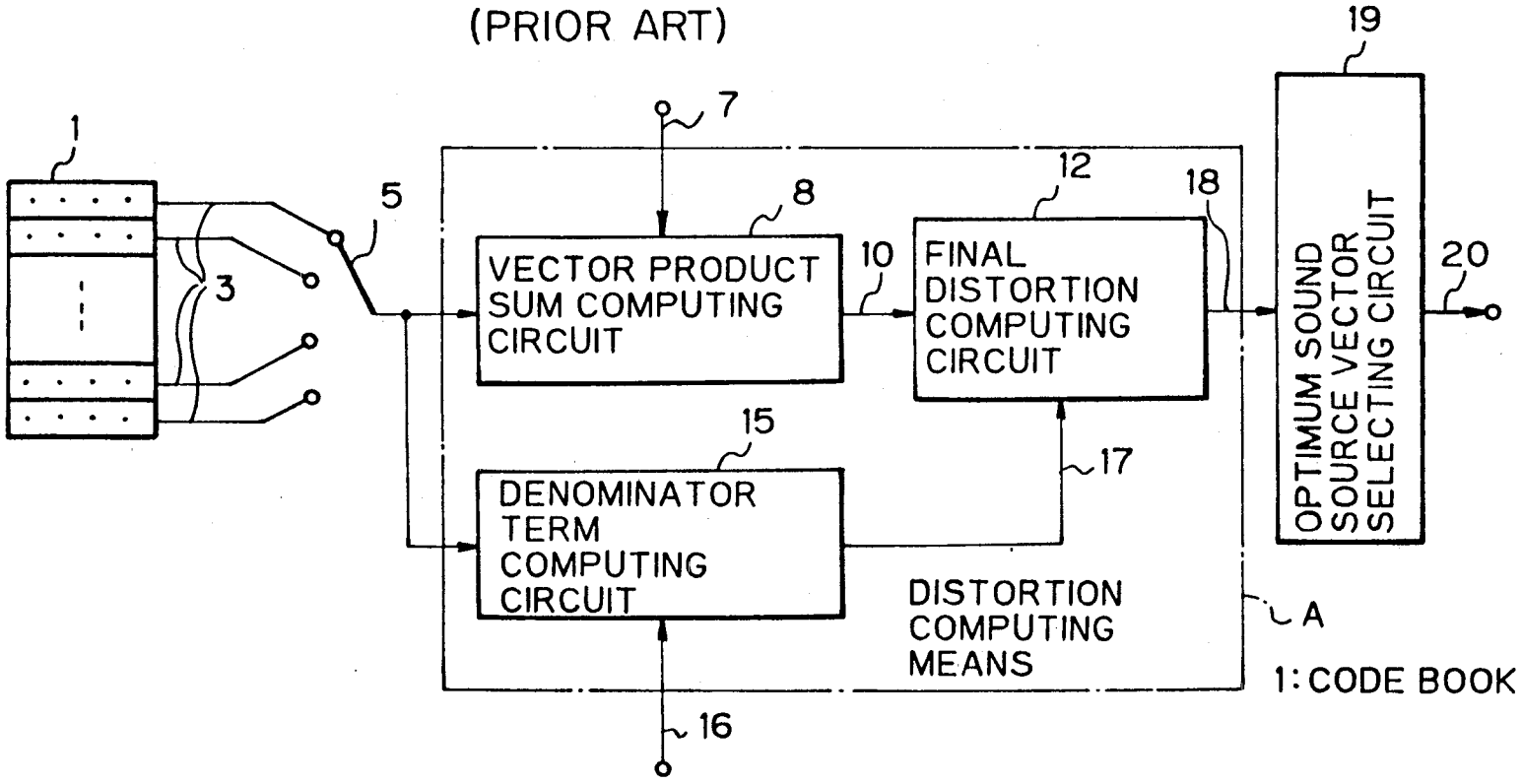
Fig. 3 (PRIOR ART)
FIG. 3 is a block diagram showing the arrangement of a conventional speech coder.
Figure 4:
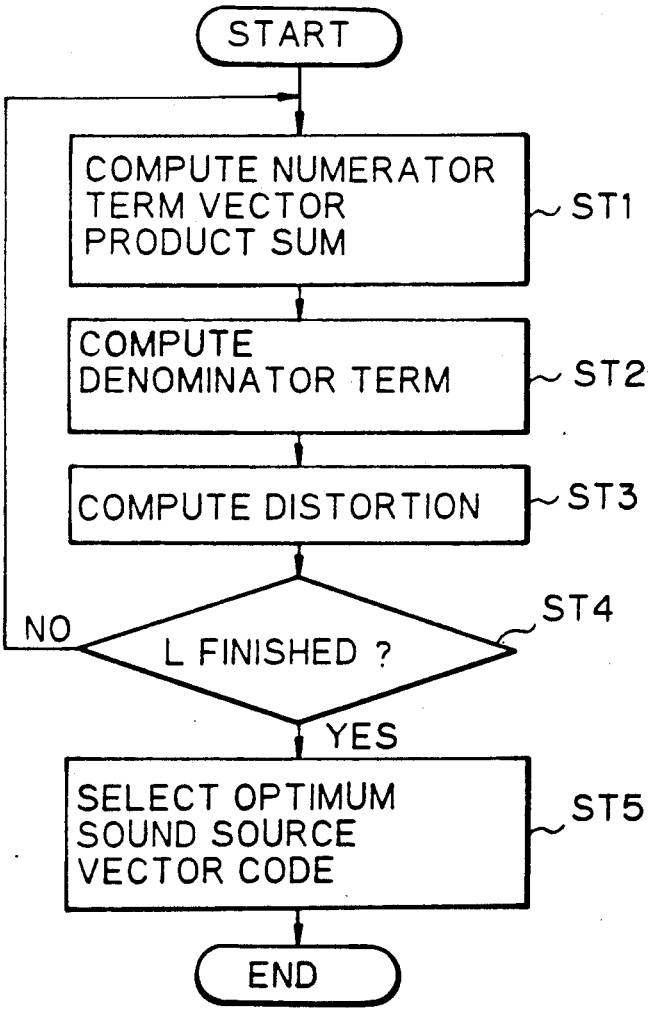
Fig. 4 (PRIOR ART)
FIG. 4 is a flowchart showing the operation of the prior art shown in FIG. 3.

FIG. 1 is a block diagram showing the arrangement of a speech coder for encoding in the frequency domain. The speech coder of FIG. 1 has two reduced code books. In FIG. 1, the same elements or portions as those in the prior art shown in FIG. 3 are denoted by the same reference numerals, and further description thereof is omitted.

Referring to FIG. 1, first reduced code book 2*a* and second reduced code book 2*b* each comprise M ($L=M^2$) DFT sound source vectors. First and second DFT sound source vectors 4*a* and 4*b* are stored in the first and second reduced code books 2*a* and 2*b*, respectively. The reference numerals 6*a* and 6*b* denote first and second change-over switches for selecting first and second DFT sound source vectors 4*a* and 4*b* from the first and second code books 2*a* and 2*b*, respectively. First and second vector product sum computing circuits 9*a* and 9*b* are respectively supplied with the selected first and second DFT sound source vectors 4*a* and 4*b*, as well as the weighted DFT input speech 7, to respectively output numerator term vector product sums 11*a* and 11*b* thereof. Vector adder 13 adds the first and second DFT sound source vectors 4*a* and 4*b* to produce a single DFT sound source vector 14. Distortion computing means B includes circuits 9*a*, 9*b*, 12 and 15.

Figure 2:
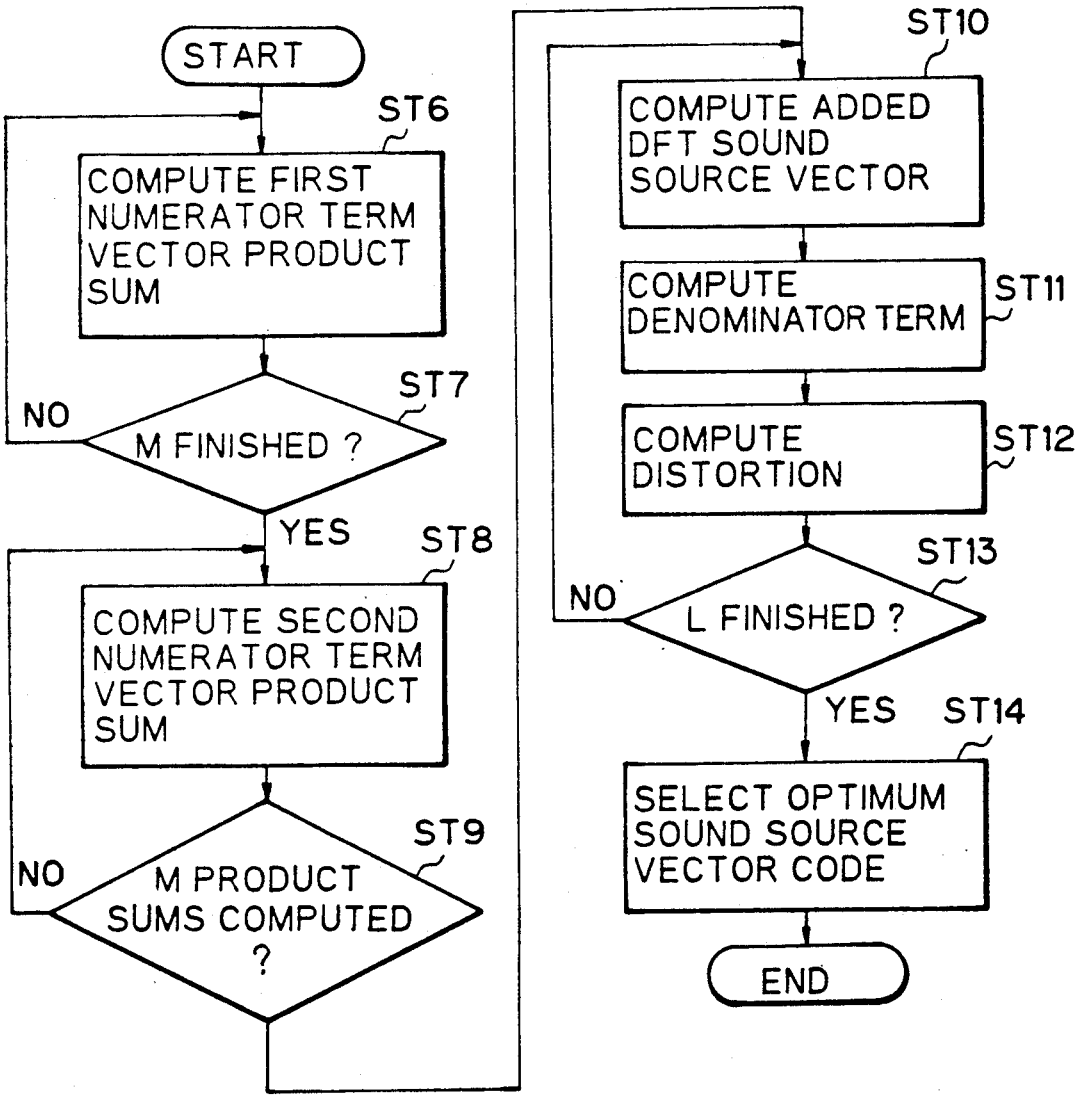
FIG. 2 is a flowchart showing the operation of the embodiment of the present invention.

The operation will next be explained by use of the flowchart shown in FIG. 2.

The operation conducted when the $k_1$-th first DFT sound source vector in the first reduced code book, and the $k_2$-th second DFT sound source vector in the second reduced code book, are used will first be explained. $A(i,k_1)$ denotes the i-th component in the $k_1$-th first DFT sound source vector, and $B(i,k_2)$ denotes the i-th component in the $k_2$-th second DFT sound source vector. Since the other parameters used in the following description are the same as those in the foregoing description of the prior art further, description thereof is omitted.

The first and second DFT sound source vectors $A(i,k_1)$ and $B(i,k_2)$, selected by the first and second change-over switches 6*a* and 6*b*, are input to the first and second vector product sum computing circuits 9*a* and 9*b*, respectively. First vector product sum computing circuit 9*a* outputs M first numerator term vector product sums $P'(k_1)$ in the same way as in the equation (2) (Steps ST6 and ST7):

$$P'(k_1) = Re. \sum_{i=1}^{N} \{Y(i)^* \cdot A(i,k_1)\} \tag{5}$$

Second vector product sum computing circuit 9*b* outputs M second numerator term vector product sums $Q'(k_2)$ in the same way as in the equation (2) (Steps ST8 and ST9):

$$Q'(k_2) = Re. \sum_{i=1}^{N} \{Y(i)^* \cdot B(i,k_2)\} \tag{6}$$

Vector adder 13 adds the first and second DFT sound source vectors $A(i,k_1)$ and $B(i,k_2)$ to produce a single DFT sound source vector $C'(i,k)$ as follows (Step ST10):

$$C'(i,k)=A(i,k_1)+B(i,k_2) \tag{7}$$

where $k=(k_1-1)M+k_2$ $k_1=1, 2, \ldots, M$ $k_2=1, 2, \ldots, M$

Since $k_2$ is changed M times per change of $k_1$, there are given L k's, from 1 to L, and hence L $C'(i,k)$'s are produced. Denominator term computing circuit 15 outputs the denominator term 17 on the basis of the DFT sound source vector $C'(i,k)$ in the same way as in the equation (3) (Step ST11):

$$\sum_{i=1}^{N} a(i)^2 \cdot |C(i,k)|^2 \tag{8}$$

Final distortion computing circuit 12 outputs the distortion E(k) on the basis of the first and second numerator vector product sums $P'(k_1)$ and $Q'(k_2)$ and the denominator term 17 in the same way as in the equation (4) (Step ST12):

$$E(k) = \sum_{i=1}^{N} |X(i)|^2 - \frac{\{P(k_1) + Q'(k_2)\}^2}{\sum_{i=1}^{N} a(i)^2 \cdot |C(i,k)|^2} \tag{9}$$

The numerator term vector product sum in the equation (4) is obtained from the relation of the equation (7) as follows:

$$\begin{aligned} Re. \sum_{i=1}^{N} \{Y(i)^* \cdot C(i,k)\} &= Re. \sum_{i=1}^{N} \{Y(i)^* \cdot (A(i,k_1) + B(i,k_2))\} \\ &= Re. \sum_{i=1}^{N} \{Y(i)^* \cdot A(i,k_1)\} + \\ &\quad Re. \sum_{i=1}^{N} \{Y(i)^* \cdot B(i,k_2)\} \\ &= P(k_1) + Q'(k_2) \end{aligned}$$

When all the L distortions E(k) have been obtained by the above-described computational operations (Step ST13), the optimum sound source vector selecting circuit 19 selects as an optimum sound source vector code 20 the number of the DFT sound source vector that gives the smallest value of the L distortions 18 (Step ST14).

The feature of the present invention resides in that the number of computational operations required for the whole numerator of the second term in the equation (4) can be reduced by a large margin. More specifically, the L vector multiply-add operations required for the equation (2) in the prior art are replaced by $2\sqrt{L}$ ($L=M^2$) vector multiply-add operations according to the equations (5) and (6) of the present invention and $\sqrt{L}$ scalar additions required for the numerator of the second term in the equation (9) of the present invention. Thus, the computational complexity is reduced.

A comparison as to the computational complexity will next be made between the prior art and the present invention. The computational complexity in the prior art will first be described.

In actual practice, the computation of the equation (2) by the vector product sum computing circuit 8 is carried out in the manner expressed by the following equation (10), while the computation of the equation (3) by the denominator term computing circuit 15 is carried out in the manner expressed by the following equation (11):

$$P(k) = \sum_{i=1}^{N} \{Re.(Y(i)^*) \cdot Re.(C(i,k)) - Im.(Y(i)^*) \cdot Im.(C(i,k))\} \tag{10}$$

$$\sum_{i=1}^{N} a(i)^2 \cdot \{(Re.(C(i,k)))^2 + (Im.(C(i,k)))^2\} \tag{11}$$

The number of computational operations required for the equation (10) is a total of 2·L·N multiplications and 2·L·N additions and subtractions, and the number of computational operations required for the equation (11) is a total of 3·L·N multiplications and 2·L·N additions. The final distortion computing circuit 12 carries out L multiplications for squaring the second term in the equation (4) and L divisions. It should be noted that, since the first term in the equation (4) is constant independently of k, it is not concerned with the selection of an optimum sound source vector and therefore no computation is carried out therefor. Assuming that the computational complexities required for a single multiplication, addition or subtraction and division are p, q and r, respectively, the overall computational complexity required for the whole second term in the equation (4) is $(5 \cdot L \cdot N + L) \cdot p + 4 \cdot L \cdot N \cdot q + L \cdot r$.

The computational complexity in the present invention will next be described. In actual practice, the computations of the equations (5) and (6) by the two vector product sum computing circuits 9a and 9b are carried out in the manner expressed by the following equations (12) and (13), and the computations of the equations (7) and (8) by the vector adder 13 and the denominator term computing circuit 15 are carried out in the manner expressed by the following equation (14):

$$P(k_1) = \sum_{i=1}^{N} \{Re.(Y(i)^*) \cdot Re.(A(i,k_1)) - Im.(Y(i)^*) \cdot Im.(A(i,k_1))\} \tag{12}$$

$$Q'(k_2) = \sum_{i=1}^{N} \{Re.(Y(i)^*) \cdot Re.(B(i,k_2)) - Im.(Y(i)^*) \cdot Im.(B(i,k_2))\} \tag{13}$$

$$\sum_{i=1}^{N} a(i)^2 \cdot \{(Re.(A(i,k_1)) + Re.(B(i,k_2)))^2 + (Im.(B(i,k_1)) + Im.(B(i,k_2)))^2\} \tag{14}$$

The number of computational operations required for the equations (12) and (13) is a total of $4 \cdot \sqrt{L} \cdot N$ multiplications and $4 \cdot \sqrt{L} \cdot N$ additions and substractions, and the number of computational operations required for the equation (14) is a total of 3·L·N multiplications and 4·L·N additions. Final distortion computing circuit 12 carries out a total of L additions for adding the first and second numerator term vector product sums, L multiplications for squaring and L divisions. Hence, the overall computational complexity required for the whole second term in the equation (9) is $(4 \cdot \sqrt{L} \cdot N + 3 \cdot L \cdot N + L) \cdot p + (4 \cdot \sqrt{L} \cdot N + 4 \cdot L \cdot N + L) \cdot q + L \cdot r$.

Accordingly, when L satisfies the following condition and is the square of an integer, it is possible to reduce the computational complexity by the present invention:

$$L > 16 \cdot N^2 \cdot (p+q)^2 / (2 \cdot N \cdot p - q)^2$$

Although in the foregoing embodiment the numbers of sound source vectors in the two code books are equal to each other, these numbers may be different from each other.

Although in the foregoing embodiment DFT added sound source vectors are produced by a vector adder, these vectors may be stored in the code books; in such a case, the computation of the equation (7) becomes unnecessary and it is possible to further reduce the computational complexity.

Although in the foregoing embodiment the present invention has been described by way of a speech coder in the frequency domain, the present invention may be applied to a speech coder that employs the Walsh-Hadamard transform domain or the singular-value decomposition. Further, although in the foregoing embodiment two reduced code books are employed, three or more reduced code books may be employed to obtain the same advantageous effects.

Thus, according to the present invention, sound source vectors which are respectively selected from a plurality of reduced code books are added together by a vector adder to produce a single sound source vector, and a distortion is computed by a distortion computing means on the basis of the sound source vector produced in the vector adder and the sound source vectors respectively selected from the reduced code books. Therefore, it suffices only to carry out, $2\sqrt{L}$ numerator term vector multiply-add operations in the vector product sum computing circuit. This is advantageous because such operations require a high computational complexity. Accordingly, when L is relatively large, the computational complexity needed for the distortion computation is reduced by a large margin compared with the prior art. The number of DFT sound source vectors which need to be stored in each code book is $2\sqrt{L}$, and the memory capacity required is reduced to $2L^{-\frac{1}{2}}$ times that in the prior art. By virtue of these two advantages, it is possible to set a satisfactorily large value for L and hence possible to code speech in high quality even by a small-scale speech coder.

Although the present invention has been described through specific terms, it should be noted here that the described embodiment is not necessarily exclusive and that various changes and modifications may be imparted thereto without departing from the scope of the invention which is limited solely by the appended claim.

What is claimed is:

1. A signal processor for analyzing distortion of a speech signal, comprising:

a plurality of reduced code books each containing a plurality of corresponding sound source vectors constituting a portion of a nonreduced code book;

a plurality of first selection means, each first selection means for selecting a single first sound source vector from a corresponding reduced code book;

a vector adder which adds the first sound source vectors respectively selected from said reduced code books to produce a single second sound source vector; and a distortion computing means for computing a distortion value on the basis of the second sound source vector produced by said vector adder and the first sound source vectors respectively selected from said reduced code books.

2. A signal processor as defined in claim 1 wherein each reduced code book stores a respective number of sound source vectors, said nonreduced code book storing a number of sound source vectors, said sound source vectors being distributed amongst said reduced code books such that a product of the number of sound source vectors stored within said reduced code books equals the number of sound source vectors stored within said nonreduced code book.

3. A signal processor as defined in claim 1 wherein each reduced code book stores a respective number of sound source vectors, the product of the respective number of sound source vectors stored in each reduced code book being equal to the number of sound source vectors stored in said nonreduced code book.

4. A signal processor as defined in claim 1 wherein said nonreduced code book stores a number of sound source vectors, said plurality of reduced code books comprising N reduced code books, each reduced code book storing a number of sound source vectors equal to the number of sound source vectors stored within said nonreduced code book raised to a power of 1/N, wherein integer N is the number of reduced code books in said plurality of reduced codebooks.

5. A signal processor as defined in claim 1 including means for intercoupling said plurality of first selection means between said plurality of reduced code books and said distortion computing means, said plurality of first selection means providing a plurality of combinations of sound source vectors respectively selected from said plurality of reduced code books.

6. A signal processor as defined in claim 5 wherein each reduced code book stores a respective number of sound source vectors, the number of sound source vectors stored being equal to a respective size for each reduced code book, said plurality of first selection means providing a number of distinct combinations of selected sound source vectors equal to a product of the sizes of the reduced code books.

7. A signal processor as defined in claim 1 wherein said distortion computing means comprises first and second vector product sum computing circuits respectively responsive to the first sound source vectors respectively selected from a first and a second of said reduced code books.

8. A signal processor as defined in claim 7 wherein said distortion computing means further comprises a denominator term computing circuit coupled from said vector adder for producing a vector product sum.

9. A signal processor as defined in claim 8 wherein said distortion computing means further comprises a final distortion computing circuit coupled from said first and second vector product sum computing circuits for producing a final distortion signal.

10. A signal processor as defined in claim 9 including means for coupling the output of the denominator term computing circuit to the final distortion computing circuit.

11. A signal processor as defined in claim 9, further comprising second selection means, responsive to the final distortion signal, for selecting one of said stored sound source vectors of said nonreduced code book having the smallest distortion.

12. A signal processor for analyzing distortion of a synthetic speech signal, comprising:

a plurality of reduced code books, each said reduced code book comprising a plurality of sound source vectors of a nonreduced code book;

a plurality of first selection means, each first selection means connected to a corresponding reduced code book for selecting a single sound source vector from that reduced code book;

a vector adder, connected to each of said plurality of first selection means, for adding the selected sound source vectors from said first selection means to produce a single sound source vector; and distortion computing means, connected to said vector adder and to said plurality of first selection means, for producing a distortion indicating signal on the basis of the sound source vector produced by the vector adder and the sound source vectors respectively selected from the reduced code books.

13. A signal processor as recited in claim 12 wherein said distortion computing means comprises analyzing means for analyzing the sound source vectors respectively output from each of the reduced code books and the sound source vector output from the vector adder.

14. A signal processor as recited in claim 12, further comprising:

second selection means, responsive to the distortion signal, for selecting the sound source vector of said plurality of reduced size code books that provides minimum distortion.

15. A speech signal processor, comprising:

a plurality of reduced size code books, each of said reduced size code books storing a plurality of sound source vectors of a nonreduced code book;

a plurality of first selection means, each of said first selection means being connected to a corresponding one of said reduced size code books for selecting a first sound source vector therefrom;

vector adding means, responsive to the first sound source vectors, for producing a second sound source vector representing the vector sum of the first sound source vectors;

a plurality of vector product sum computing means, each responsive to a corresponding one of the first sound source vectors and to an input speech signal for producing a vector product sum signal representative of the vector product sum thereof, said plurality of vector product sum computing means thereby producing a plurality of vector product sum signals; and distortion computing means, responsive to the second sound source vector and the plurality of vector product sum signals, for producing a distortion signal indicative of distortion of synthetic speech caused by the first sound source vectors from the input speech signal.

16. A signal processor as recited in claim 15, further comprising:

second selection means, responsive to the distortion signal, for producing a selection signal identifying a said sound source vector having the smallest distortion indicated by the distortion signal.

* * * * *